US007698781B2

(12) United States Patent
Cai

(10) Patent No.: US 7,698,781 B2
(45) Date of Patent: Apr. 20, 2010

(54) SLIDING WHEELS FOR DRAPERY

(76) Inventor: Yiwei Cai, 1411 N. Grand Ave., #200, Covina, CA (US) 91724

( * ) Notice: Subject to any disclaimer, the term of this patent is extended or adjusted under 35 U.S.C. 154(b) by 859 days.

(21) Appl. No.: 11/472,242

(22) Filed: Jun. 20, 2006

(65) Prior Publication Data

US 2007/0289090 A1 Dec. 20, 2007

(51) Int. Cl.
*A47H 13/00* (2006.01)
*E05D 15/00* (2006.01)

(52) U.S. Cl. ..... 16/87.2; 16/87.6 R; 16/91; 16/106; 16/107

(58) Field of Classification Search ..... 16/87.6 R, 16/87.2, 87 R, 87.4 R, 91, 97, 102, 107, 106, 16/45, 46; 160/330, 340, 341, 345–347, 160/123; 49/409, 410, 411, 412; 384/531–532
See application file for complete search history.

(56) References Cited

U.S. PATENT DOCUMENTS 1,198,252 A * 9/1916 Marx ..... 16/98
1,232,563 A * 7/1917 Kail ..... 16/105
2,783,493 A * 3/1957 Gussack ..... 16/97
3,076,222 A * 2/1963 Sloan ..... 16/98
3,293,685 A * 12/1966 Rosenbaum ..... 16/87.6 R
5,349,783 A * 9/1994 Jasperson et al. ..... 49/425
6,131,243 A * 10/2000 Lee ..... 16/87.2
6,141,827 A * 11/2000 Wu ..... 16/91
6,189,182 B1 * 2/2001 Ko ..... 16/87.6 R

* cited by examiner

*Primary Examiner*—Chuck Y. Mah
(74) *Attorney, Agent, or Firm*—Clement Cheng

(57) ABSTRACT

A drapery arrangement includes a drapery fabric, a sliding track, and a plurality of sliding wheels. Each of the sliding wheels includes a sliding hanger, a wheel seat, a central connecting shaft, and a plurality of sliding elements. The wheel seat, having a rotating groove, is adapted to fittedly receive in a toggle cavity of the sliding hanger, wherein the wheel seat has a through connecting channel extended along a radial direction thereof. The central connecting shaft penetrates though the connecting channel enhancing a structural rigidity of the respective sliding wheel, and evenly distributing a load imposed on the sliding wheel. The plurality of sliding elements is rotatably received in the rotating groove for running on a circular sidewall of the toggle cavity, wherein the sliding wheel is slidably mounted on the sliding track for sliding therealong.

9 Claims, 4 Drawing Sheets

SLIDING WHEELS FOR DRAPERY

BACKGROUND OF THE PRESENT INVENTION

1. Field of Invention

The present invention relates to sliding wheels arrangement for a curtain, and more particularly to a sliding wheel slidably suspending a curtain cloth, wherein each of the sliding wheels has an enhanced supporting structure for slidably supporting the curtain thereby.

2. Description of Related Arts

Window curtains are used in buildings mainly for shielding sunlight and to create privacy for people. They are also used for decoration especially for home. A window curtain usually comprises a curtain cloth for shielding sunlight and a sliding mechanism which suspends the curtain cloth and is also capable for sliding along a gliding track for opening and closing of window curtains.

The present invention relates to the sliding wheel of the window curtain. A conventional sliding wheel usually comprises a sliding hanger having a hanging arm to suspend the curtain cloth, a sliding support having a pair of wheel seating jointed together by ultrasonic welding and a plurality of sliding elements installed within to enhance the sliding ability.

Regarding to such conventional sliding wheel, some drawbacks can be found. First, the pair of wheel seating jointed by ultrasonic welding requires extra labor cost. It is often not repairable or replaceable with a single part. The whole wheel seating unit is usually replaced when the unit is damaged. Thus, welding the pair of wheel seating together permanently is not practical in the sense of manufacturing and liability.

Second, the conventional two pieces joint wheel seating may not be secure enough for supporting various kinds of stress from a wide variety of circumstances. For examples, U.S. Pat. No. 6,189,182 discloses a guiding block for pulling a window curtain. The sliding support here in this patent is jointed by a left wheel seat and a right wheel seat with a locking mechanism. The left wheel seat has a left spacer with a through hole on the center thereof as the primary body itself and a convex tube extended from one side and a rib is installed inside the convex tube. The right wheel seat has a right spacer with a through hole on the center thereof as the primary body itself and a convex tube that is extended from one side for insertion and a notch that is longitudinally installed with the convex tube and a circular groove is installed on the outside of the convex tube. The two wheel seats are then jointed together when the right wheel seat is inserted into the left wheel seat where the convex tube of the right wheel seat is enforced through the rib of the left wheel seat. The faces of the rib and the convex tube of the left wheel seat couple with the faces of circular groove and the right spacer of the right wheel seat respectively so that the two wheel seats are locked together. In the case here, the main disadvantage is that there is insufficient support for the wheel seats especially when the sliding wheel is experiencing abnormal stresses. The reason is because both the wheel seats are hollow in center and the hollow convex tubes do not provide enough support when they go under heavy or sudden loading. The existence of the notch of the right wheel seat also decreases the strength of the structure. Another disadvantage of this design is that if one of the wheel seats breaks, then it is required to replace the whole wheel seat.

SUMMARY OF THE PRESENT INVENTION

A main object of the present invention is to provide a sliding wheel for selectively sliding drapery, such as a curtain, which has enhanced rigidity and prolonged product life span as compared with conventional arts.

Another object of the present invention is to provide a sliding wheel for selectively sliding a curtain, wherein the sliding wheel comprises a central supporting shaft which is capable of evenly withstanding loads attributed by the weight of the curtain, and maintaining the structural integrity of the entire sliding wheel.

Another object of the present invention is to provide a sliding wheel for sliding a drapery, such as a curtain, which is easy and inexpensive to repair when the unit is broken as compared with conventional arts.

Another object of the present invention is to provide a sliding wheel for sliding a drapery, such as a curtain, which does not involve complicated mechanical structure, so as to minimize the manufacturing cost and other related expenses of the sliding wheel.

Accordingly, in order to accomplish the above objects, the present invention provides a drapery arrangement, comprising:

a drapery fabric;

a sliding track having a sliding groove longitudinally formed therealong; and a plurality of sliding wheels, each of the sliding wheels comprises:

a sliding hanger having a top toggle portion and a hanging arm downwardly extended from the top toggle portion for connecting with a top edge portion of the drapery fabric, wherein the top toggle portion has a through toggle cavity formed therein;

a wheel seat, having a rotating groove, adapted to fittedly receive in the toggle cavity of the sliding hanger, wherein the wheel seat has a through connecting channel extended along a radial direction thereof;

a central connecting shaft penetrating though the connecting channel for not only enhance a structural rigidity of the respective sliding wheel, but also evenly distributing a load imposed on the sliding wheel thereto; and a plurality of sliding elements rotatably received in the rotating groove for running on a circular sidewall of the toggle cavity, wherein the sliding wheel is slidably mounted on the sliding track for sliding therealong so as to slide the drapery fabric along the sliding track without significant risk of the sliding wheel being damaged by excessive weight applied thereto.

Moreover, the present invention also provides a sliding wheel for slidably supporting a drapery fabric on a sliding track having a sliding groove, comprising:

a sliding hanger having a top toggle portion and a hanging arm downwardly extended from the top toggle portion for connecting with a top edge portion of the drapery fabric, wherein the top toggle portion has a through toggle cavity formed therein;

a wheel seat, having a rotating groove, adapted to fittedly receive in the toggle cavity of the sliding hanger, wherein the wheel seat has a through connecting channel extended along an axial direction thereof;

a central connecting shaft penetrating though the connecting channel for not only enhance a structural rigidity of the respective sliding wheel, but also evenly distributing a load imposed on the sliding wheel; and a plurality of sliding elements rotatably received in the rotating groove for running on a circular sidewall of the toggle cavity, wherein the sliding wheel is slidably mounted on the sliding track for sliding therealong so as to slide the drapery fabric along the sliding track without significant risk of the sliding wheel being damaged by excessive weight applied thereto.

These and other objectives, features, and advantages of the present invention will become apparent from the following detailed description, the accompanying drawings, and the appended claims.

DETAILED DESCRIPTION OF THE PREFERRED EMBODIMENT

Figure 1:
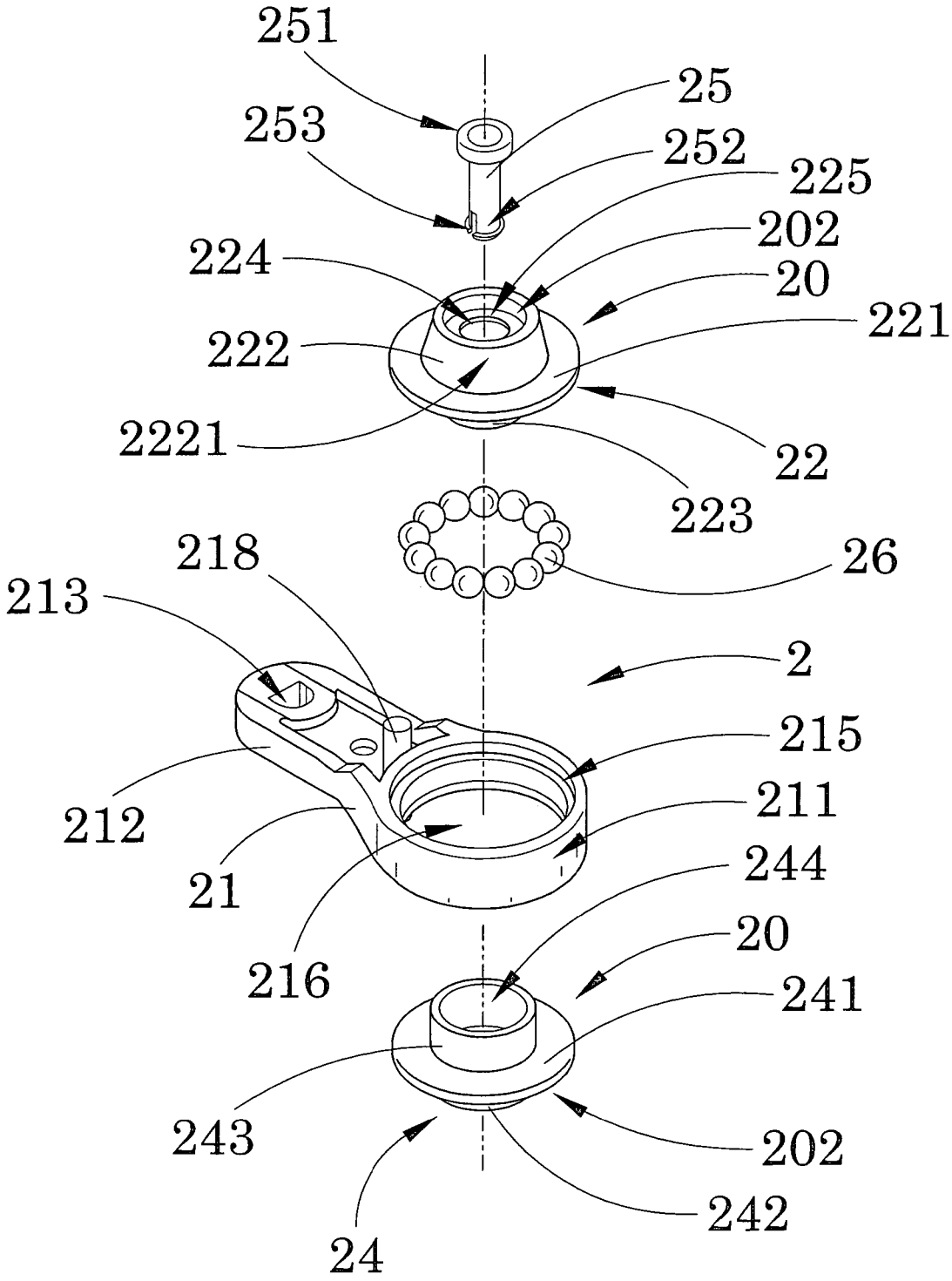
FIG. 1 is an exploded perspective view of a sliding wheel according to a preferred embodiment of the present invention.
Figure 2:
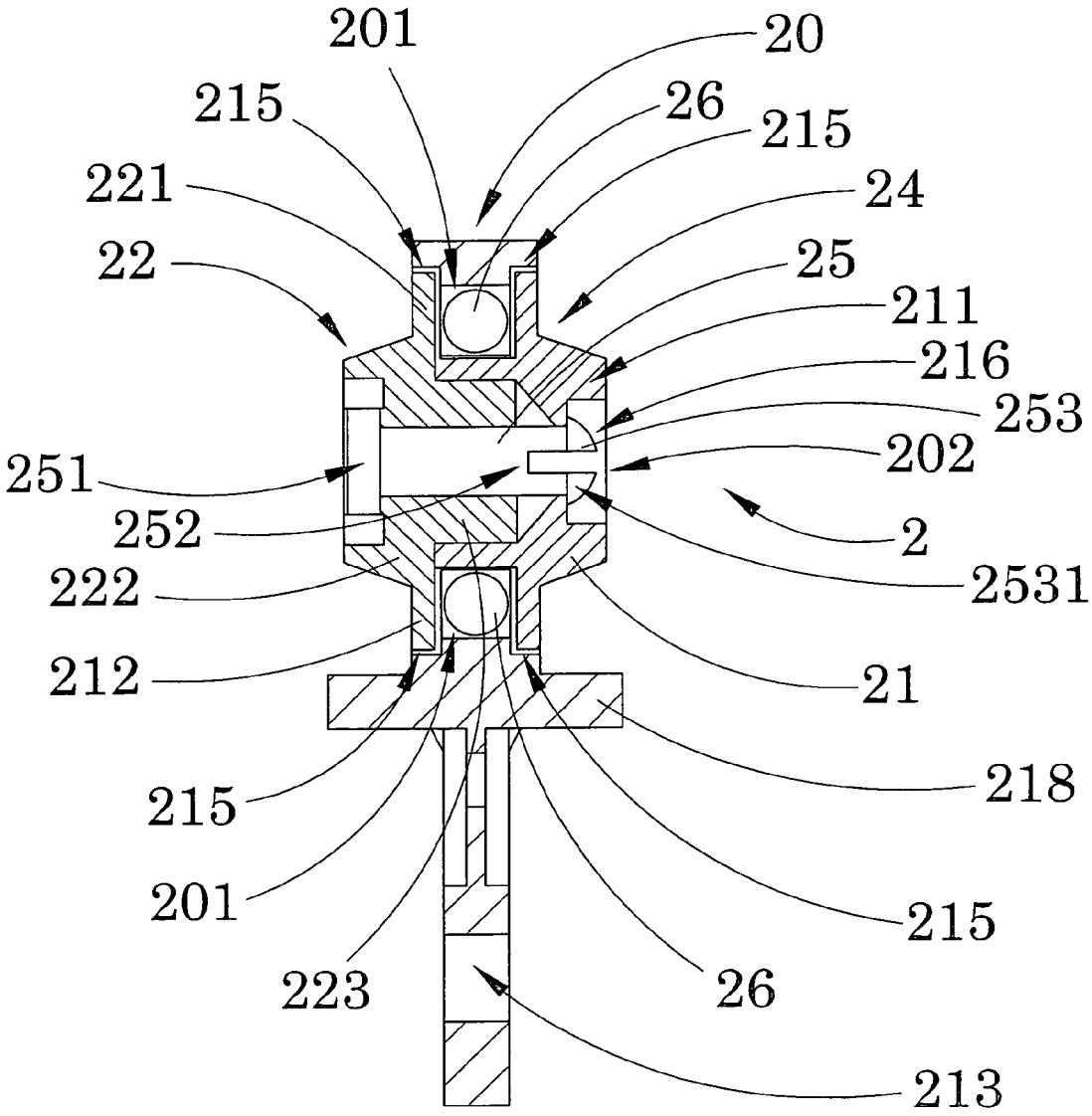
FIG. 2 is a cross sectional view of the sliding wheel according to the above preferred embodiment of the present invention.
Figure 3:
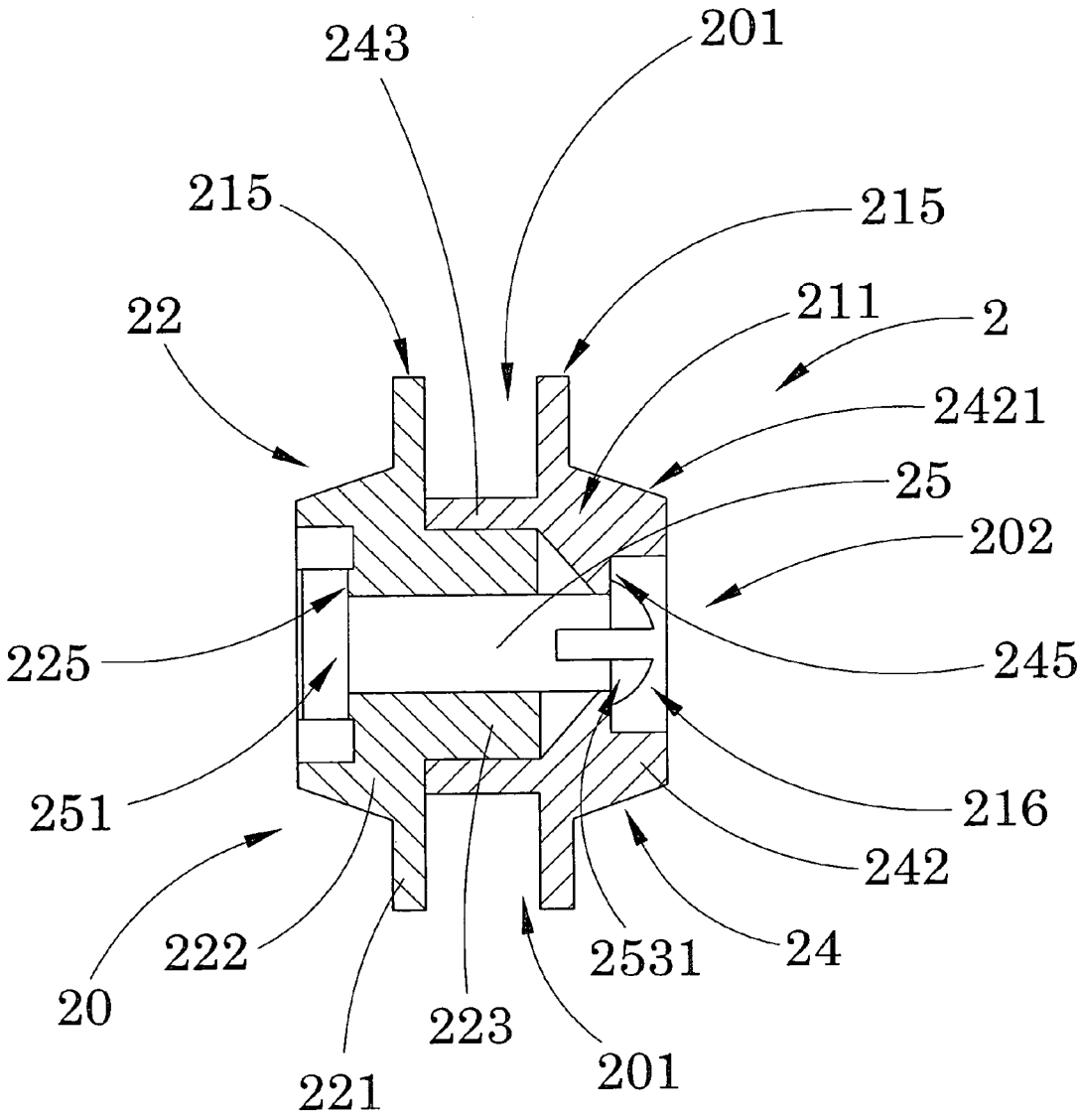
FIG. 3 is a cross sectional view of the sliding wheel according to the above preferred embodiment of the present invention.
Figure 4:
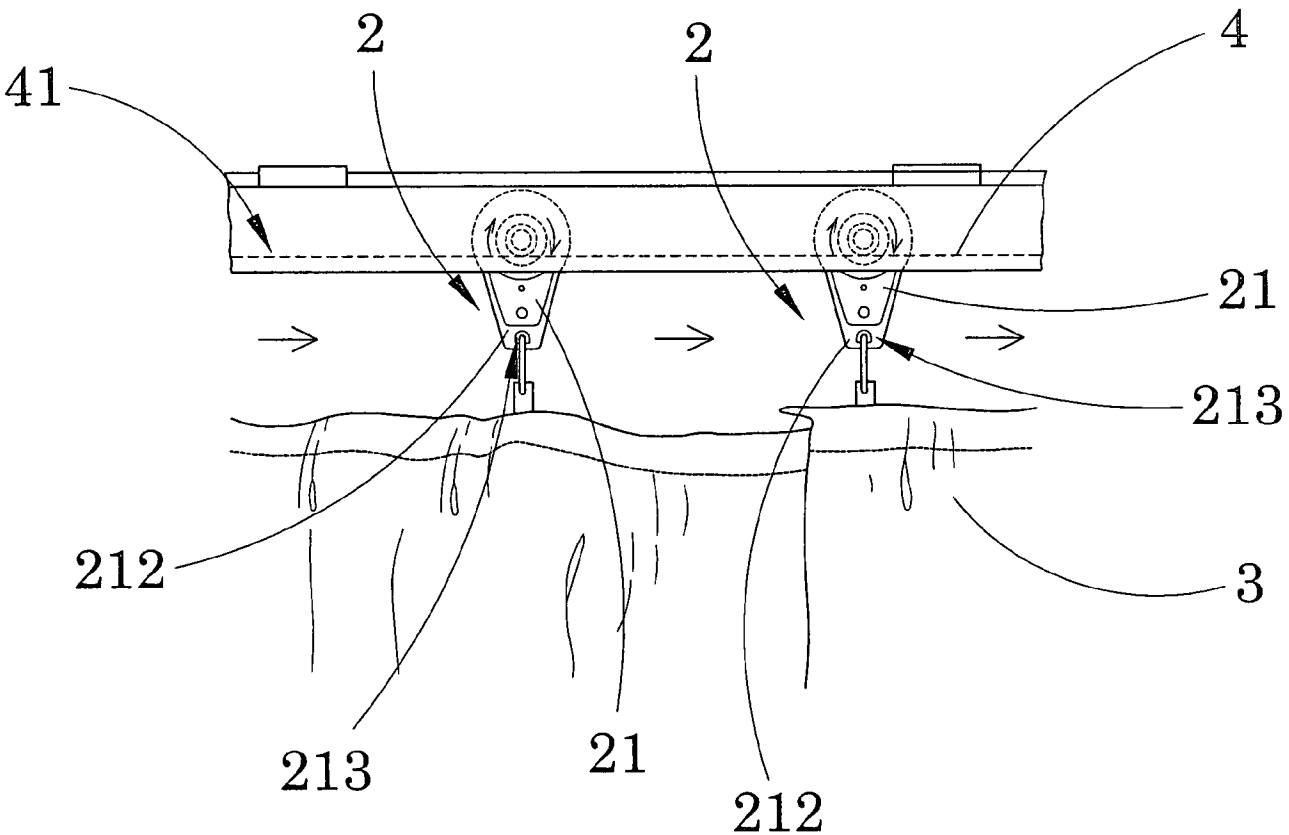
FIG. 4 is a schematic diagram of the sliding wheel according to the above preferred embodiment of the present invention.

Referring to FIG. 1 to FIG. 4 of the drawings, a drapery arrangement according to a preferred embodiment of the present invention is illustrated, in which the drapery arrangement comprises a drapery fabric 3, a sliding track 4, and a plurality of sliding wheels 2. The drapery fabric 3 is meant to be embodied as a wide variety of drapery, such as a window curtain, so that the sliding track 4 and the sliding wheels 2 are capable of moving the window curtain for opening or closing thereof. As a result, the sliding track 4 has a sliding groove 41 longitudinally formed therealong for guiding a sliding motion of the sliding wheels 2.

Each of the sliding wheels 2 comprises a sliding hanger 21, a wheel seat 20, a central connecting shaft 25, and a plurality of sliding elements 26. The sliding hanger 21 has a top toggle portion 211 and a hanging arm 212 downwardly extended from the top toggle portion 211 for connecting with a top edge portion of the drapery fabric 3, wherein the top toggle portion 211 has a through toggle cavity 216 formed therein.

The wheel seat 20, having a rotating groove 201, adapted to fittedly receive in the toggle cavity 216 of the sliding hanger 21, wherein the wheel seat 20 has a through connecting channel 202 extended along an axial direction thereof.

The central connecting shaft 25 penetrates though the connecting channel 202 for not only enhance a structural rigidity of the respective sliding wheel 2, but also evenly distributing a load imposed on the sliding wheel 2.

The plurality of sliding elements 26 is rotatably received in the rotating groove 201 for running on a circular sidewall of the toggle cavity 216, wherein the sliding wheel 2 is slidably mounted on the sliding track 4 for sliding therealong so as to slide the drapery fabric 3 along the sliding track 4 without significant risk of the sliding wheel 2 being damaged by excessive weight applied thereto.

According to the preferred embodiment of the present invention, the top toggle portion 211 of the sliding hanger 21 is circular in shape with a through hole on the center thereof located on the upper potion of the sliding hanger 21. Two ribs 215 are spacedly installed on the side section of the inner rim of the toggle portion 211. The toggle cavity 216 is defined by the hollow section formed by the inner rim of the toggle portion 211.

The hanging arm 212 is located on the lower portion of the sliding hanger 21, and further has a hanging hole 213 for being hooked by a hanging pin on the upper portion of the drapery fabric 3. A retaining pillar 218 is extended from the two sides of the hanging arm 212 for confining the hanging arm 212 with a predetermined angle between the hanging arm 212 and the sliding track 4.

The wheel seat 20 further comprises a first wheel casing 22 and a second wheel casing 24 detachably coupled with each other within the toggle cavity 216 to form the wheel seat 20 having the rotating groove 201. More specifically, the first wheel casing 22 has a first seat panel 221 with a through hole on the center thereof. The first seat panel 221 has an outer diameter slightly larger than the inner diameter of the corresponding rib 215 of the toggle portion 211 of the sliding hanger 21 so that the first wheel casing 22 is adapted to receive in the toggle cavity 216 with the first seat panel 221 biasing against the corresponding rib 215 of the toggle portion 211.

Moreover, the first wheel casing 22 further has a tubular holder 222 which is cylindrical and tapered in shape with a through hole on the center thereof, and is extended from an outer side of the first seat panel 221, and a first coupling holder 223 concentrically and inwardly extended from inner side of the first seat panel 221 to locate in the toggle cavity 216. The first wheel casing 22 further has a first passage channel 224 coaxially extended along the first wheel casing 22, wherein the first passage channel 224 has a substantial contracted portion and enlarged portion formed in the tubular holder 222 of the first wheel casing 22 to define a first biasing shoulder 225 between the contracted portion and the enlarged portion of the first passage channel 224, so that when the central connecting shaft 25 is inserted into the wheel seat 20 for securely connecting the first wheel casing 22 and the second wheel casing 24, a head portion 251 of the central connecting shaft 25 is adapted to bias against the first biasing shoulder 225. In other words, a further movement of the central connecting shaft 25 can be substantially restricted by the first biasing shoulder 225 which also helps in retaining the central connecting shaft 25 in position within the toggle cavity 216.

It is worth mentioning that the tapered tubular holder 222 defines a slanted guiding surface 2221 formed as an outer surface thereof for allowing a sliding movement of the sliding wheel 2 when it is installed in the sliding track 4.

On the other hand, the second wheel casing 24 has a second seat panel 241 with a through hole formed on the center thereof. The second seat panel 241 has an outer diameter slightly larger than the inner diameter of the rib 215 of the toggle portion 211 of the sliding hanger 21 so that the second wheel casing 24 is adapted to receive in the toggle cavity 216 with the second seat panel 241 biasing against the corresponding rib 215 of the toggle portion 211.

Moreover, the second wheel casing 24 further has a tubular sleeve 242 which is cylindrical and tapered in shape with a through hole on the center thereof, and is extended from an outer side of the second seat panel 241, and a second coupling holder 243 concentrically and inwardly extended from inner side of the second seat panel 241 to locate in the toggle cavity 216. The second wheel casing 24 further has a second passage channel 244 coaxially extended along the second wheel casing 24, wherein the second passage channel 244 has a substantial contracted portion and enlarged portion formed in the tubular sleeve 242 of the second wheel casing 24 to define a second biasing shoulder 245 between the contracted portion and the enlarged portion of the second passage channel 244, so that when the central connecting shaft 25 is inserted into the wheel seat 20 for securely connecting the first wheel casing 22 and the second wheel casing 24, a tail portion 252 of the central connecting shaft 25 is adapted to engage with the second biasing shoulder 225 for substantially retaining in the toggle cavity 216. In other words, a further movement of the central connecting shaft 25 can be substantially restricted by both the first biasing shoulder 225 and the second biasing shoulder 245.

It is worth mentioning that the tapered tubular sleeve 242 defines a slanted guiding surface 2421 formed as an outer surface thereof for allowing a sliding movement of the sliding wheel 2 when it is installed in the sliding track 4. At this stage, it is important to point out that the first and the second passage channel 224, 244 define the through connecting channel 202 of the wheel seat 20 for the central connecting shaft 25 to penetrate therethrough so as to couple the first wheel seat 22 with the second wheel seat 24 in the toggle cavity 216.

As briefly mentioned earlier, the central supporting shaft 25 has the head portion 251 and the tail portion 252, wherein the head portion 251 is enlarged in cross section for biasing against the first biasing shoulder 225 of the wheel seat 20, while the central supporting shaft 25 further comprises a plurality of elastic holding arms 253 extended at the tail portion 252 of the central supporting shaft 25. When the central supporting shaft 25 is inserted into the connecting channel 202, the elastic holding arms 253 are adapted to elastically engage with the second biasing shoulder 245 for restricting a lateral movement between the wheel seat 20 and the central supporting shaft 25.

According to the preferred embodiment of the present invention, each of the elastic holding arms 253 has an enlarged clipping portion 2531 adapted for biasing against the second biasing shoulder 245 when the central supporting shaft 25 is inserted into the connecting channel 202. In other words, a diameter of the contracted portion of the second passage channel 244 is smaller than a diameter of the tail portion of the central supporting shaft 25 so that the elastic holding arms 253 are arranged to be slightly depressed with the central supporting shaft 25 is forced to insert into the connecting channel 202 until the elastic holding arms 253 are released to engage with the second biasing shoulder 245 when they pass through the contracted portion of the second passage channel 244.

It is worth remarking that the overall strength of the structure is enhanced by using the central supporting shaft 25 as a support between the first wheel seat 22 and the second wheel seat 24 because the stress from pulling of curtain cloth can be evenly distributed along the central supporting shaft 25.

The second coupling holder 243 has a diameter slight larger than a diameter of the tubular holder 222 so that the tubular holder 222 is adapted to insert into the second coupling holder 243 for the first wheel seat 22 and the second wheel seat 24 coupling with each other within the toggle cavity 216. The central supporting shaft 25 is then inserted into the connecting channel 202 for securing coupling the first wheel seat 22 with the second wheel seat 24 to form the rotating groove 201 between the two seat panels 221, 241. Consequently, the sliding elements 26 are freely received in the rotating groove 201 to facilitate the rotational movement of the wheel seat 20.

The operation of the present invention is as follows: the sliding wheels 2 are mounted onto the sliding track 4 in such a manner that when the sliding wheels 2 are slid along the sliding track 4, the drapery fabric 3 is driven to move for being opened and closed so as to, say, open and close a window opening by the drapery fabric 3.

Finally, it is worth mentioning that the sliding elements 26 are preferably embodied as a plurality of metal balls running in the rotating groove 201 for facilitating a rotational motion of the wheel seat 2 within the toggle cavity 216.

In view of the above, the present invention substantially achieves the above mentioned objects and has the following advantages:

1. Having enhanced rigidity as compared with conventional arts by using the retaining shaft in the sliding support.

2. Easy and cheap to replace as the retaining shaft is most likely the part to break down when the sliding wheel is experiencing abnormal stresses.

3. The sliding wheel does not require involve complicated mechanical structure, so as to minimize the manufacturing cost and other related expenses of the sliding wheel as compared with conventional arts.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A drapery arrangement, comprising:

a sliding track having a sliding groove longitudinally formed therealong; and a plurality of sliding wheels, each of said sliding wheels comprises:

a sliding hanger having a top toggle portion and a hanging arm extending from said top toggle portion connecting with a top edge portion of a drapery fabric, wherein said top toggle portion has a toggle cavity formed therein;

a wheel seat, having a rotating groove, adapted to fittedly receive in said toggle cavity of said sliding hanger, wherein said wheel seal has a through connecting channel extended along a radial direction thereof;

a central connecting shaft penetrating though said connecting channel for not only enhance a structural rigidity of said respective sliding wheel, but also evenly distributing a load imposed on said sliding wheel; and a plurality of sliding elements rotatably received in said rotating groove for running on a circular sidewall of said toggle cavity, wherein said sliding wheel is slidably mounted on said sliding track for sliding therealong so as to slide said drapery fabric along said sliding track without significant risk of said sliding wheel being damaged by excessive weight applied thereto;

a tapered tubular sleeve having a slanted guiding surface formed as an outer surface thereof for allowing a sliding movement of the sliding wheel when it is installed in the sliding track, wherein each of said wheel seat of said sliding wheel further comprises a first wheel casing and a second wheel casing coupled with each other within said wheel cavity through penetration of said central supporting shaft so as to form said wheel seal having said rotating groove, wherein said central supporting shaft has an enlarged head portion for engaging with said first wheel casing, and a tail portion, and comprises a plurality of elastic holding arms extended at a tail portion of said central supporting shaft, wherein when said central supporting shaft is inserted into said connecting channel, said elastic holding arms are adapted to elastically engage with said second wheel casing for restricting a lateral movement between said wheel seat and said central supporting shaft, wherein said top toggle portion of said sliding hanger is circular in shape with a through hole formed on a center thereof, and has two ribs spacedly formed on an inner sidewall of said through hole of said toggle portion for defining said toggle cavity of said sliding hanger to rotatably receive said wheel seat within said toggle cavity, wherein said first wheel casing has a first seat panel, a tubular holder outwardly extended from an outer side of said first seat panel, and a first coupling holder inwardly extended from an inner side of said first seat panel to couple with said second wheel seat within said toggle cavity, wherein said first seat panel, said tubular holder and said first coupling holder define a first passage channel coaxially and extended across said tubular holder, said first seat panel, and said first coupling holder for said central supporting shaft to be inserted therein, wherein said first seat panel has an outer diameter slightly larger than an inner diameter of said corresponding rib of said sliding hanger so that said first seat panel is adapted to bias against said rib in said toggle cavity for retaining said first seat panel in position, wherein said first passage channel has a contracted portion and an enlarged portion formed in said tubular holder of said first wheel casing to define a first biasing shoulder between said contracted portion and said enlarged portion of said first passage channel for restricting an axial movement of said central support shaft when said central connecting shaft is inserted to couple said first wheel casing and said second wheel casing.

2. A sliding wheel for a drapery fabric and a sliding track having a sliding groove longitudinally formed therealong, comprising:

a sliding hanger having a top toggle portion and a hanging arm downwardly extended from said top toggle portion for connecting with a top edge portion of said drapery fabric, wherein said top toggle portion has a toggle cavity formed therein;

a wheel seat, having a rotating groove, adapted to fittedly receive in said toggle cavity of said sliding hanger, wherein said wheel seat has a through connecting channel extended along a radial direction thereof;

a central connecting shaft penetrating though said connecting channel, wherein the central connecting shaft abuts a tapered tubular sleeve; and a plurality of sliding elements rotatably received in said rotating groove for running on a circular sidewall of said toggle cavity, further comprising a slanted guiding surface defined by the tapered tubular sleeve, wherein said sliding wheel is slidably mounted on said sliding track for sliding therealong so as to slide said drapery fabric along said sliding track, wherein each of said wheel seat of said sliding wheel further comprises a first wheel casing and a second wheel casing coupled with each other within said wheel cavity through penetration of said central supporting shaft so as to form said wheel seat having said rotating groove, wherein said central supporting shaft has an enlarged head portion for engaging with said first wheel casing, and a tail portion, and comprises a plurality of elastic holding arms extended at a tail portion of said central supporting shaft, in such a manner that when said central supporting shaft is inserted into said connecting channel, said elastic holding arms are adapted to elastically engage with said second wheel casing for restricting a lateral movement between said wheel seat and said central supporting shaft.

3. The sliding wheel, as recited in claim 2, wherein said top toggle portion of said sliding hanger is circular in shape with a through hole formed on a center thereof, and has two ribs spacedly formed on an inner sidewall of said through hole of said toggle portion for defining said toggle cavity of said sliding hanger to rotatably receive said wheel seat within said toggle cavity.

4. The sliding wheel, as recited in claim 3, wherein said first wheel casing has a first seat panel, a tubular holder outwardly extended from an outer side of said first seat panel, and a first coupling holder inwardly extended from an inner side of said first seat panel to couple with said second wheel seat Within said toggle cavity, wherein said first seat panel, said tubular holder and said first coupling holder define a first passage channel coaxially and extended across said tubular holder, said first seat panel, and said first coupling holder for said central supporting shaft to be inserted therein.

5. The sliding wheel, as recited in claim 4, wherein said first seat panel has an outer diameter slightly larger than an inner diameter of said corresponding rib of said sliding hanger so that said first seat panel is adapted to bias against said rib in said toggle cavity for retaining said first seat panel in position, wherein said first passage channel has a contracted portion and an enlarged portion formed in said tubular holder of said first wheel easing to define a first biasing shoulder between said contracted portion and said enlarged portion of said first passage channel for restricting an axial movement of said central support shaft when said central connecting shaft is inserted to couple said first wheel casing and said second wheel casing.

6. A drapery arrangement, comprising:

a drapery fabric;

a sliding track having a sliding groove longitudinally formed therealong; and a plurality of sliding wheels, each of said sliding wheels comprises:

a sliding hanger having a top toggle portion and a hanging arm downwardly extended from said top toggle portion for connecting with a top edge portion of said drapery fabric, wherein said top toggle portion has a toggle cavity formed therein;

a wheel seat, having a rotating groove, adapted to fittedly receive in said toggle cavity of said sliding hanger, wherein said wheel seat has a through connecting channel extended along a radial direction thereof;

a central connecting shaft penetrating though said connecting channel; and a plurality of sliding elements rotatably received in said rotating groove for running on a circular sidewall of said toggle cavity, further comprising a slanted guiding surface abutting a tapered tubular sleeve, wherein said sliding wheel is slidably mounted on said sliding track for sliding therealong so as to slide said drapery fabric along said sliding track, wherein each of said wheel seat of said sliding wheel further comprises a first wheel casing and a second wheel casing coupled with each other within said wheel cavity through penetration of said central supporting shaft so as to form said wheel seal having said rotating groove, wherein said central supporting shaft has an enlarged head portion for engaging with said first wheel casing, and a tail portion,(and comprises a plurality of elastic holding arms extended at a tail portion of said central supporting shaft, in such a manner that when said central supporting shaft is inserted into said connecting channel, said elastic holding arms are adapted to elastically engage with said second wheel casing for restricting a lateral movement between said wheel seat and said central supporting shaft.

7. The sliding wheel, as recited in claim 6, wherein said top toggle portion of said sliding hanger is circular in shape with a through hole formed on a center thereof, and has two ribs spacedly formed on an inner sidewall of said through hole of said toggle portion for defining said toggle cavity of said sliding hanger to rotatably receive said wheel seat within said toggle cavity.

8. The sliding wheel, as recited in claim 7, wherein said first wheel casing has a first seat panel, a tubular holder outwardly extended from an outer side of said first seat panel, and a first coupling holder inwardly extended from an inner side of said first seat panel to couple with said second wheel seat within said toggle cavity, wherein said first seat panel, said tubular holder and said first coupling holder define a first passage channel coaxially and extended across said tubular holder, said first seat panel, and said first coupling holder for said central supporting shaft to be inserted therein.

9. The sliding wheel, as recited in claim 8, wherein said first seat panel has an outer diameter slightly larger than an inner diameter of said corresponding rib of said sliding hanger so that said first seat panel is adapted to bias against said rib in said toggle cavity for retaining said first seat panel in position, wherein said first passage channel has a contracted portion and an enlarged portion formed in said tubular holder of said first wheel casing to define a first biasing shoulder between said contracted portion and said enlarged portion of said first passage channel for restricting an axial movement of said central support shaft when said central connecting shaft is inserted to couple said first wheel casing and said second wheel casing.

* * * * *